US005988269A

United States Patent [19]

Karlsson et al.

[11] Patent Number: 5,988,269

[45] Date of Patent: Nov. 23, 1999

[54] PLATE HEAT EXCHANGER

[75] Inventors: Sven Karlsson, Löddeköpinge; Sven Andersson, Landskrona; Thomas Dahlberg, Helsingborg; Veikko Pihlajaniemi, Lund, all of Sweden

[73] Assignee: SWEP International AB, Landskrona, Sweden

[21] Appl. No.: 09/051,923

[22] PCT Filed: Oct. 21, 1996

[86] PCT No.: PCT/SE96/01339

§ 371 Date: Apr. 23, 1998

§ 102(e) Date: Apr. 23, 1998

[87] PCT Pub. No.: WO97/15798

PCT Pub. Date: May 1, 1997

[30] Foreign Application Priority Data

Oct. 23, 1995 [SE] Sweden ..... 9503709

[51] Int. Cl.[6] ..... F28F 3/08

[52] U.S. Cl. ..... 165/167; 165/DIG. 372

[58] Field of Search ..... 165/166, 167

[56] References Cited

U.S. PATENT DOCUMENTS

| | | | |
|---|---|---|---|
| 4,871,017 | 10/1989 | Cesaroni | 165/167 X |
| 4,987,955 | 1/1991 | Bergqvist et al. | 165/167 |
| 5,462,113 | 10/1995 | Wand | 165/167 |

FOREIGN PATENT DOCUMENTS

| | | | |
|---|---|---|---|
| 611941 | 8/1994 | European Pat. Off. | 165/167 |
| 237997 | 10/1986 | Japan | 165/167 |

*Primary Examiner*—Leonard Leo
*Attorney, Agent, or Firm*—Laurence R. Brown

[57] ABSTRACT

A plate heat exchanger for two or more flowing media may according to the invention be designed so that the front and rear cover plates (1, 8) of the exchanger act as channel defining walls for a flowing heat exchanging medium, and so that the tube connections at the inlet and outlet ports (10–13) can be established in a common plane. This is obtained thereby that the front and rear cover plates (1, 8) together with the adjacent first (2) and last (5) channel forming plates define distribution channels (18) crossing the direction between adjacent inlet and outlet ports.

5 Claims, 8 Drawing Sheets

PLATE HEAT EXCHANGER

The present invention relates to a plate heat exchanger.

More particularly the invention relates to a plate heat exchanger comprising a front cover plate, a plurality of channel forming plates and a rear cover plate—all being of a basically symmetric shape relative an axis extending in the direction of the length of the exchanger, the said front cover plate being provided with fittings for connections to inlet and outlet ports for heat exchanging media, the said channel forming plates being provided with a pressed pattern.

A heat exchanger should have a large heat exchanging capacity relative to its cost to manufacture and its volume. The cost of manufacture will decrease with decreasing number of parts and with increasing heat exchange capacity per channel forming plate. It is usually desired that equal connection heights are obtained at the inlet and outlet ports for the heat exchanging media and—in case O-ring connections are used—that the sealing, surfaces are located in a common plane at the end surface of the exchanger.

In certain applications, e.g. in case one of the media is of a delicate nature, it is a must that the heat exchanger does not have any blind channels or voids in which some of a heat exchanging medium could be trapped and not hollow the rest of the flow or in which the flow velocity becomes very low. A stop or a very small flow will cause a risk of crevice corrosion or freezing.

The present invention has for its object to provide a plate heat exchanger which better meets these wishes, and this is according to the present invention obtained thereby that even the front cover plate is provided with a pressed pattern, that the areas of said front cover plate around the inlet and outlet ports are located in a common plane, and that the said cover plate together with the adjacent channel forming plate provides a distribution channel crossing the direction between adjacent inlet and outlet ports and bordering areas around said ports in which plane parts of the said cover plate and the adjacent channel forming plate are contacting each other.

Figure 1:
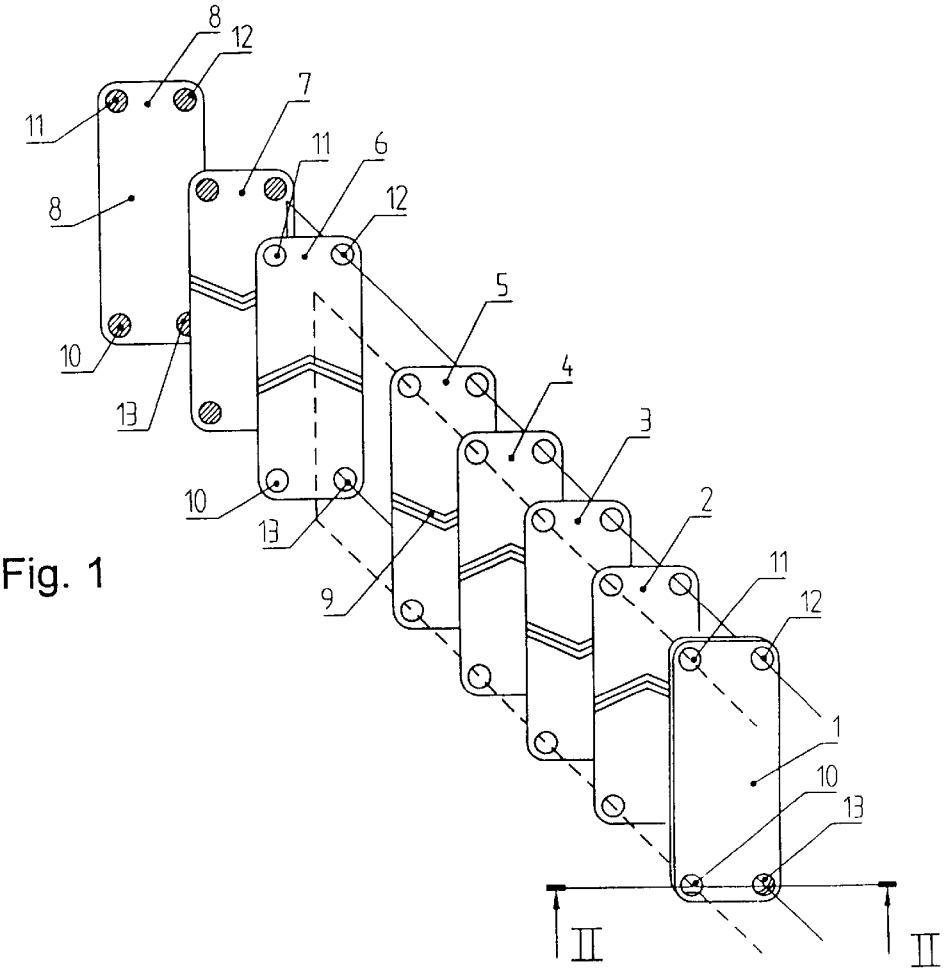
Figure 2:
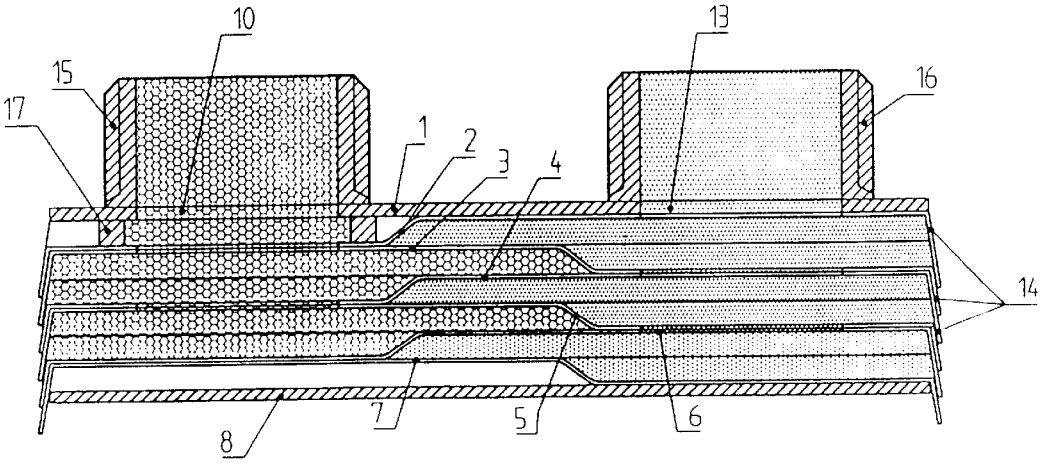
Fig. 2 PRIOR ART
Figure 3:
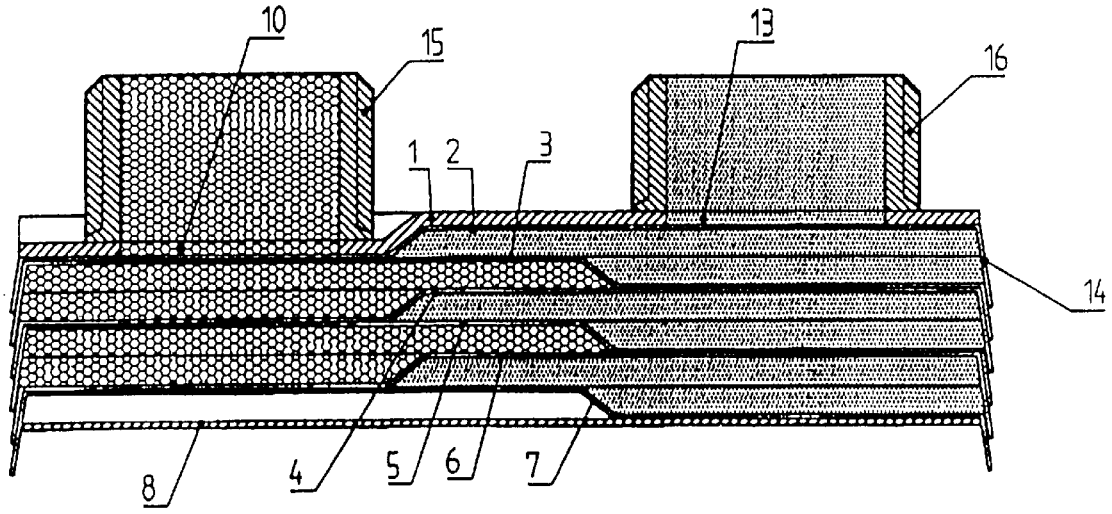
Fig.3 PRIOR ART
Figure 4:
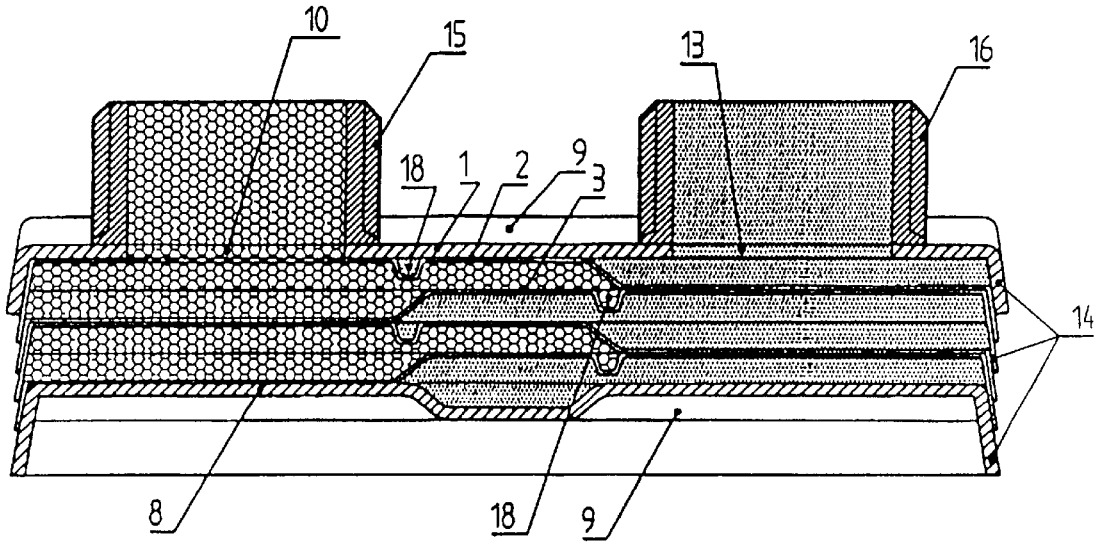
Figure 5:
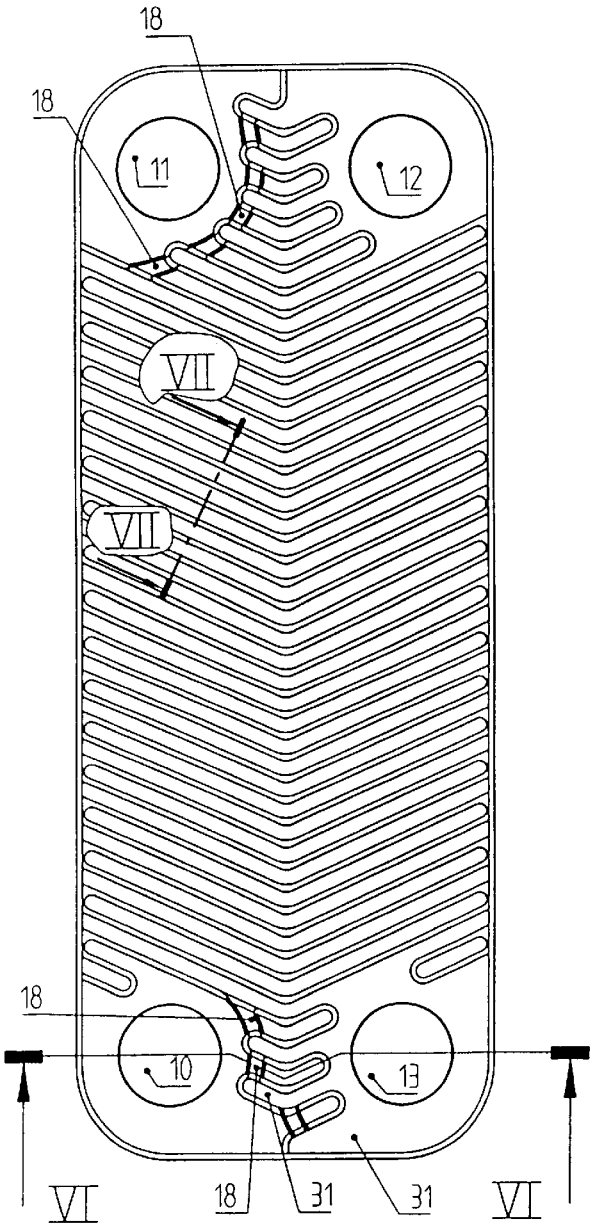
Figure 7:
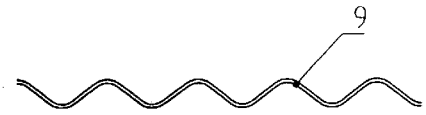
Figure 6:
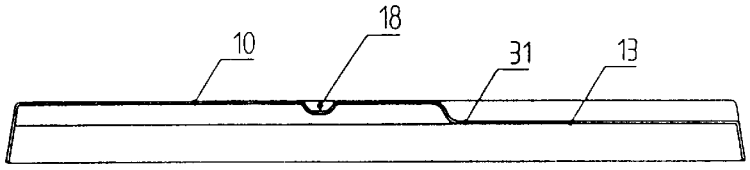
Figure 8:
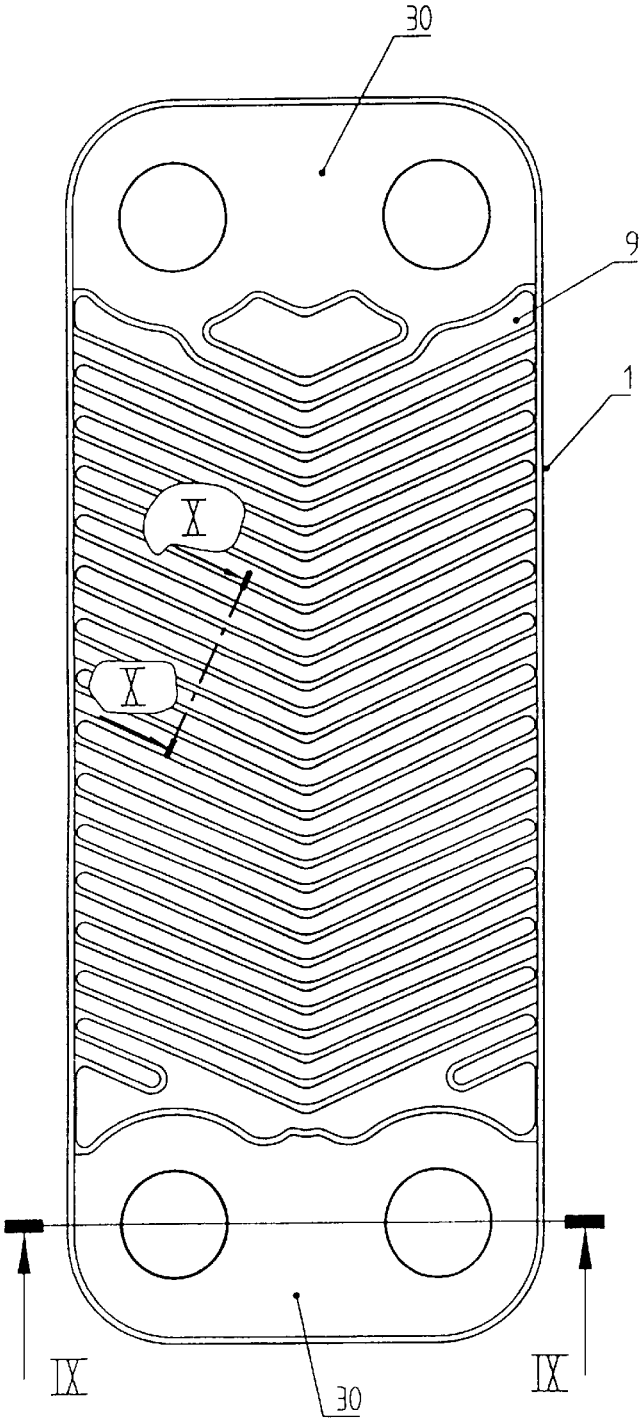
Figure 10:
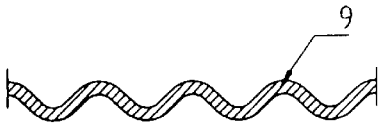
Figure 9:
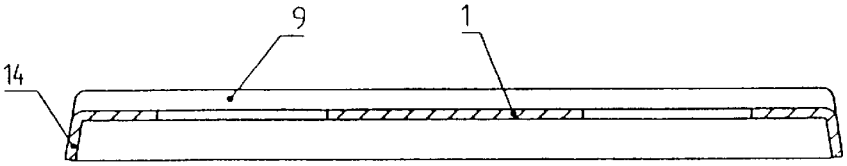
Figure 11:
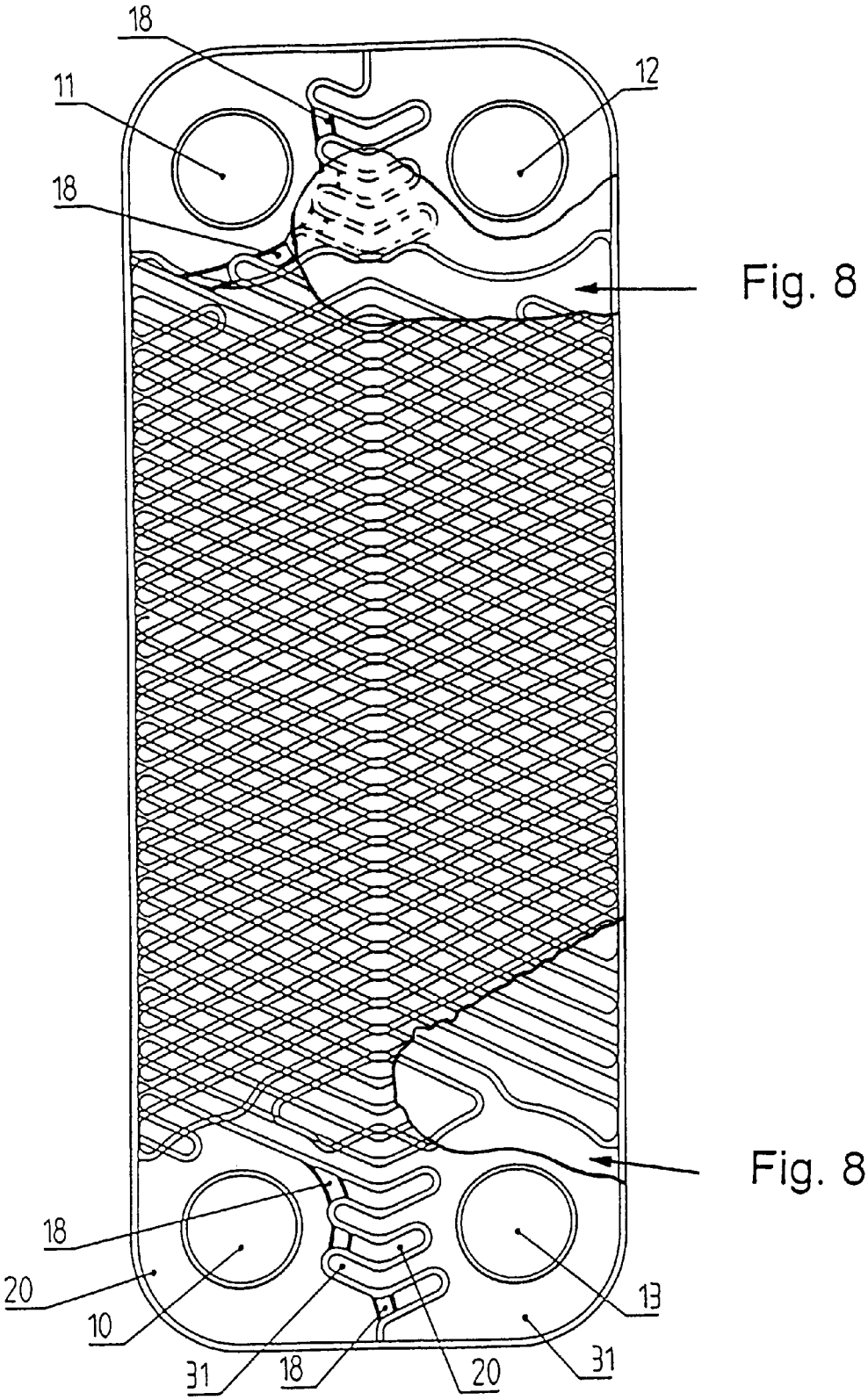
Figure 12:
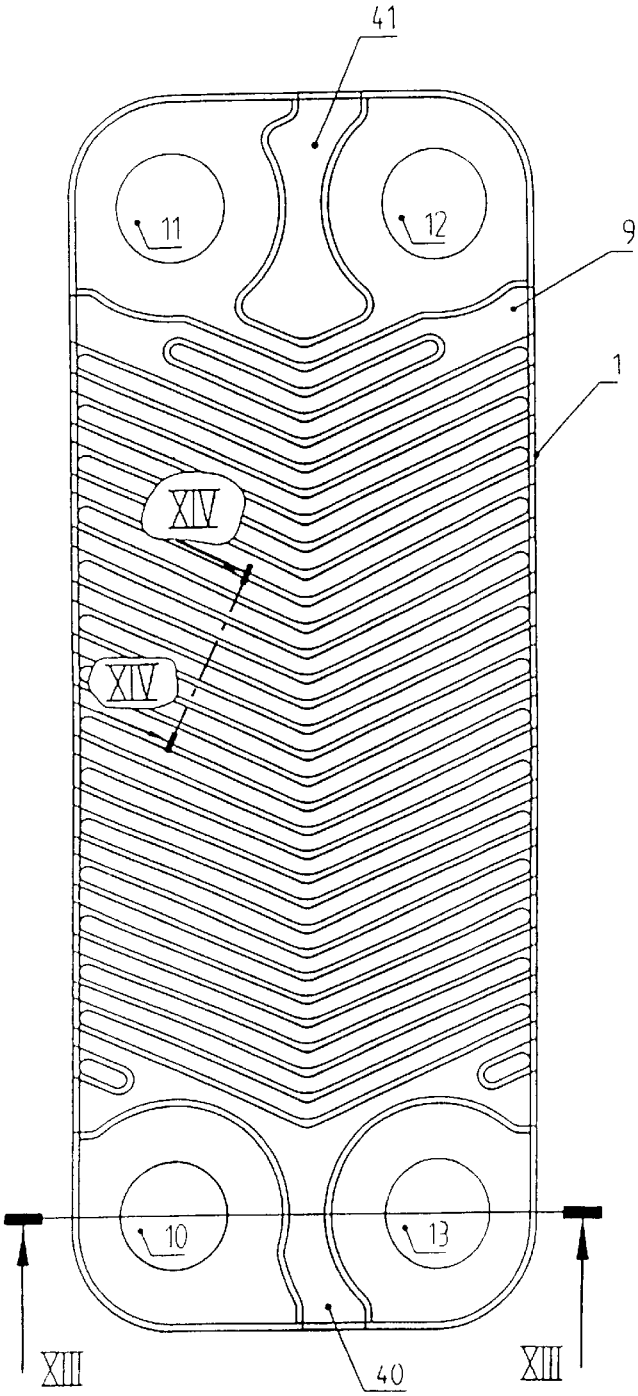
Figure 14:
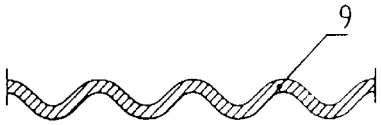
Figure 13:
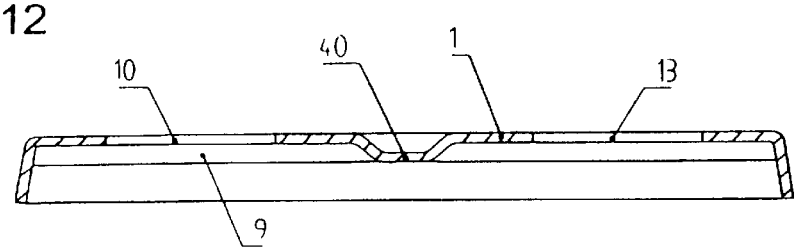
Figure 15:
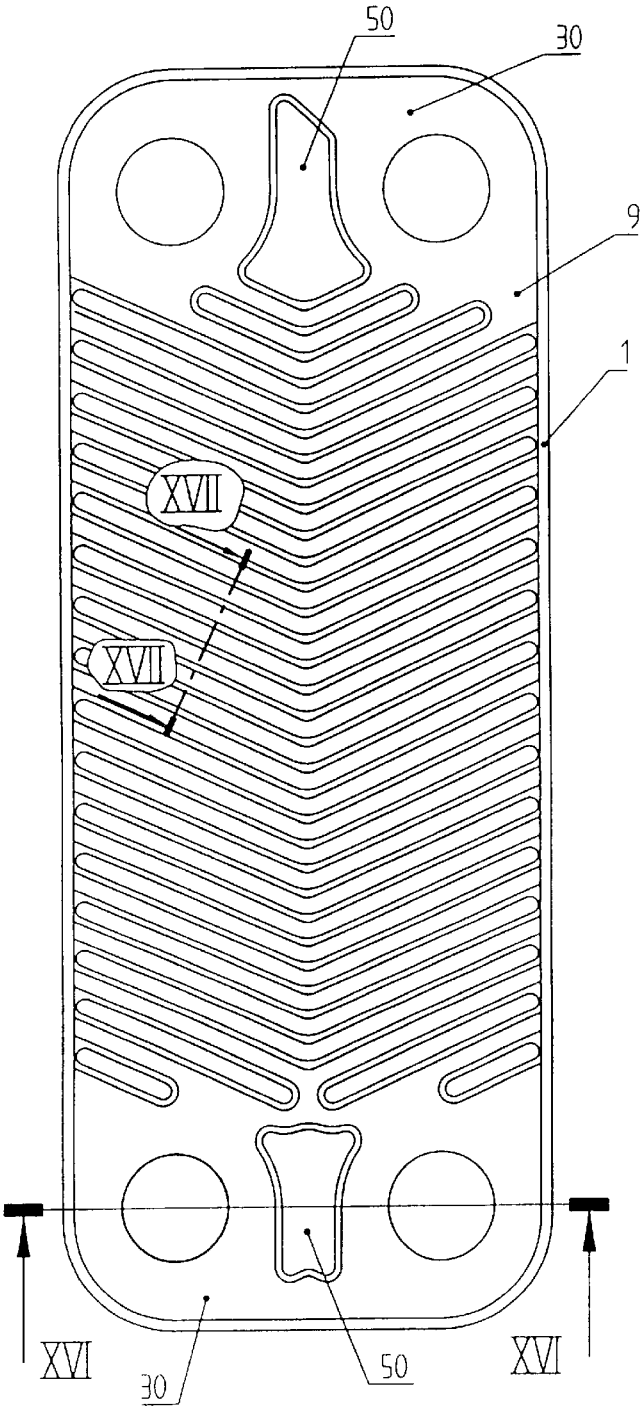
Figure 17:
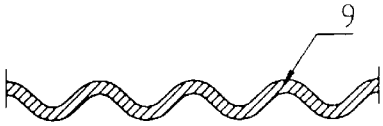
Figure 16:
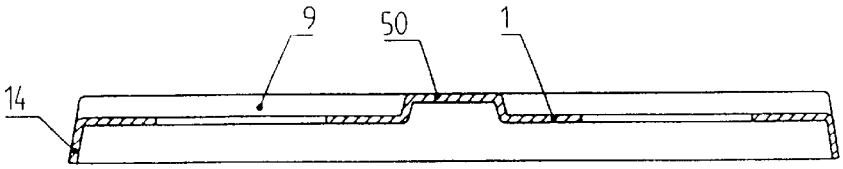
Figure 18:
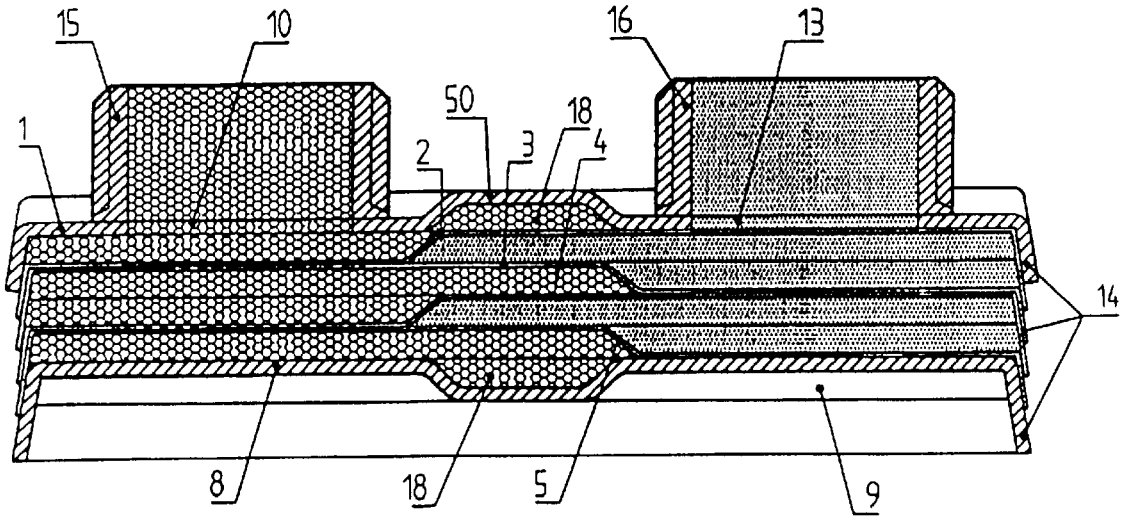

The invention will be described below in more detail reference being made to the drawings in which FIG. 1 is an exploded view showing the basic design of a two circuit plate heat exchanger, FIG. 2 is a section in the direction of the arrows II—II through a known heat exchanger according to the principle of FIG. 1, FIG. 3 is a corresponding section through another known plate heat exchanger, FIG. 4 is a corresponding section through a plate heat exchanger according to the present invention, FIG. 5 is a plane view of a channel forming plate according to the present invention, FIG. 6 is a section along the line VI—VI in FIG. 5 at a greater scale, FIG. 7 is a section along the line VII—VII in FIG. 5—also at a greater scale, FIG. 8 is a plane view of the front cover plate in the heat exchanger of FIG. 4, FIG. 9 is a section along the line IX—IX in FIG. 8 at a greater scale, FIG. 10 is a section along the line X—X in FIG. 8 at a greater scale, FIG. 11 shows the flow between the front cover plate and an adjacent channel forming plate, FIGS. 12, 13 and 14 show the rear cover plate, FIG. 15, 16 and 17 show an alternative design of the front cover plate, and FIG. 18 is a section corresponding to FIG. 4 through a heat exchanger having the alternative design of the front cover plate shown in FIGS. 15–17 and channel forming plates of known design (FIGS. 2 or 3) and a rear cover plate according to FIGS. 12–14.

FIG. 1 shows a number of mainly rectangularly shaped plates arranged after each other. The plates are of substantially length-symmetric shape—i.e. almost symmetric relative a plane vertically disposed relative the plate through a central line in the plate. The plate designated by 1 is a front cover plate and is followed by a number of channel forming plates 2–7, while the last plate 8 is a rear cover plate. The channel plates 2–7 are of identical shape, but a following channel plate has been turned 180° relative the antecedent one. All channel plates have a pressed pattern of arrow ridges 9 and, therefore, although the plates are stacked to contact each other, channels are formed between them. The number of channel forming plates could be greater or less than the six shown in FIG. 1.

Each plate has four holes designated by 10, 11, 12 and 13. The holes 10 form an inlet port for a first heat exchanging medium and the holes 11 form an outlet port for the same first medium. The holes 12 form an inlet port for a second heat exchanging medium and the holes 13 form an outlet port for said second medium. As will be understood front the following explanations with reference to FIG. 2 a channel will be formed between the channel plates 2 and 3 after stacking and joining the plates e.g. by brazing. Only the second heat exchanging medium will be able to pass between said plates 2 and 3 in the downwards direction. Similar channels for said second heat exchanging medium will be formed between the channel forming plates 4–5 and 6–7. Likewise channels will be formed between the plates 3–4 and 5–6 through which only said first heat exchanging medium may pass upwardly. All channel forming plates are made of thin sheets of a material being conductive to heat—e.g. a metal.

The two heat exchanging media will pass countercurrently through their respective systems of channels.

FIG. 2 shows a section of FIG. 1 in the direction of the arrows II—II at a greater scale. In this known design the front cover plate 1 has been directly brazed to the first channel plate 2 which—like the remaining channel forming plates 3–7—has a circumferentially extending, downwardly and slightly outwardly directed collar 14. When stacking the plates the collars 14 will engage each other and make it possible to form a sealing connection by brazing. The front cover plate 1 has been provided with a brazed tubular fitting 15 at the inlet port 10 for the said first heat exchanging medium and with a tubular fitting 16 at the outlet port 13 for said second heat exchanging medium. As it is desired that the two fittings 15 and 16 should have equal heights the areas of the cover plate 1 around the ports 10 and 13 should be located in the same plane. This is also a necessity in case the fittings should be replaced by O-ring connections direct to the cover plate 1. Consequently no channel for a heat exchanging medium can be made between the cover plate 1 and parts to the channel forming plate 2. In order to seal against entrance of heat exchanging medium between the cover plate 1 and the channel plate 2 a spacer ring 17 has been provided and fastened between them by brazing. The drawback in this known design is that the front cover plate 1 has no channel forming function and that the spacer ring 17 is an extra element in the device. Also the rear cover plate 8 is not used as a wall in a channel for a heat exchanging medium.

FIG. 3 shows how the front cover plate 1 previously has been formed so that the spacer ring can be omitted. As shown in FIG. 3 this is obtained thereby that the areas of the cover plate 1 around the ports 10 and 13 have been located in different planes, and this makes the use of O-ring seals at the tube connections to the heat exchanger difficult. Also the tube connections will be more complicated. The design according to FIG. 3 does not either make it possible to use the cover plate 1 as a wall limiting a channel for a heat exchanging medium.

FIG. 4 shows an embodiment according to the present invention. The front cover plate 1 has the same arrow shaped pattern 9 of ridges and depressions as the channel plates 2–7 and also the same circumferential collar 14 for a sealing braze connection to the first channel forming plate 2. Around the inlet port 10 the first channel plate 2 has partial depressions 18 forming distribution channels between the cover plate 1 and the channel plate 2. These distribution channel forming depressions 18 will be described in more detail wish reference to FIG. 5 showing from above a channel forming plate according to the invention. FIG. 4 shows also the rear cover plate 8—even this provided with a pressed pattern 9 and a collar 14.

The channel plate shown in FIG. 5 has the four previously discussed ports: the inlet ports 10 and 12 as well as the outlet ports 11 and 13. As will be seen when following the section shown in FIG. 6 along the line VI—VI in FIG. 5 from the area around the port 10 in the direction against the port 13 you first meet the distribution channel 18 as a short depression after which the same level is reached as that around the port 10. After a little more than half the distance to the port 13 the level or the plate is lowered by approximately twice the depth of the distribution channel 18. The difference between the levels of the plate areas around the two holes 10 and 13 corresponds to the depth of the pressed arrow shaped pattern 9 as shown in FIG. 7. The section VI—VI follows the top of a ridge from the distribution channel 18 to the plane area 31 around the port hole 13.

The channel forming plate 3 has the same appearance as the channel plate 2, but it has been turned 180°, so that the distribution channels 18 in the channel plate 3 will be located around the ports 12 and 13.

FIG. 8 shows from above the front cover plate 1. From the section—FIG. 9—in the direction of the arrows IX—IX shown in FIG. 8 it appears that the plate areas around all ports 10–13 are located in a common plane. Also shown is the pressed arrow shaped pattern 9 and the collar 14.

The channel system in the plate heat exchanger between the front cover plate 1 and the adjacent channel forming plate 2 will be described with reference to FIG. 11 and also to FIG. 4. The flow passing between the cover plate 1 and the channel plate 2 is a follow of the second heat exchanging medium and enters through port 12 and exits through port 13. The pattern ridges of the channel plate 2 and plate areas located at the same level have been designated by 20. The front cover plate 1 which should be placed on the top of the channel plate 2 should be turned 180° relative the position in FIG. 8 in order to obtain opposite directions of the contacting arrow shaped patterns. Thus it will be the plane area 30 at the top of FIG. 8 which covers the area around the ports 10 and 13 in FIG. 11. The area 20 in FIG. 11 around the port 10 will completely contact the cover plate 1 (and be brazed to said plate). The distribution channels 18 will drain the areas 31 (FIG. 5) which otherwise would form blind channels containing stationary heat exchanging medium.

FIGS. 12, 13 and 14 show the rear cover plate. FIG. 12 is a plane view, whereas FIGS. 13 and 14 are sections along the lines XIII—XIII and XIV—XIV respectively. The areas around the ports 10–13 are located in a common plane, and the areas 40, 41 at the shorter sides of the plate are located in a lower plane as will be seen in FIG. 13. The last mentioned areas together with the adjacent channel forming plate will form distribution channels having the same draining function as the previously described channels 18.

FIG. 15 shows an alternative design of the front cover plate 1. FIGS. 16 and 17 are sections along the lines XVI—XVI and XVII—XVII respectively. Here related parts 50 have been pressed between the ports at the shorter sides of the cover plate. As shown in FIG. 18—which corresponds to FIG. 4—said elevated parts 50 will have the same draining function as the distribution channels 18 in the embodiment shown in FIG. 4.

Compared with the known designs shown in FIGS. 2 and 3 a saving corresponding to the cost of two channel forming plates (and in some cases even two spacer rings) as well as the cost for mounting and storage is obtained. However, said saving should be reduced by the greater cost of material for a cover plate and the cost of forming the cover plates.

The rear cover plate 8 may be provided with holes for tube connections. However, in e.g. a two or three circuit heat exchanger system in which all tube connections are established at the front cover plate 1 such holes at the rear cover plates should be blinded.

We claim:

1. A plate heat exchanger comprising a front cover plate (1), a plurality of channel forming plates (2–5) and a rear cover plate (8), said plates being of a basically symmetric shape relative to an axis extending in a direction of the length of the heat exchanger, said front cover plate (1) being provided with fittings for connections to inlet and outlet ports (10, 12 and 11, 13, respectively) for heat exchanging media, the channel forming plates (2–5) being provided with a pressed pattern (9), wherein said front cover plate (1) is provided with the pressed pattern (9), areas (30) of said front cover pate (1) around the inlet and outlet ports (10–13) are located in a common plane, and said front cover plate (1) together with an adjacent channel forming plate (2) provides a distribution channel (18) crossing a direction between adjacent inlet and outlet ports of respective heat exchanging media (10–13, 11–12) and bordering areas around said ports in which plane parts of said front cover plate (1) and the adjacent channel forming plate (2) are contacting each other.

2. A plate heat exchanger according to claim 1, wherein the channel forming plate (2) adjacent to the front cover plate (1) in areas around the inlet and outlet ports (10, 11) of one of the heat exchanging media is provided with downwardly depressed parts so that contact between the front cover plate (1) and the adjacent channel forming plate (2) establishes the distribution channel (18) for draining heat exchanging media from voids (31) formed between the adjacent inlet and outlet ports (10–13, 11–12) of the respective heat exchanging media by the pressed pattern (9) between the front cover plate (1) and the adjacent channel forming plate (2).

3. A plate heat exchanger according to claim 1, wherein the front cover plate (1) is provided with an upwardly pressed part (5) between the inlet and outlet ports the adjacent inlet and outlet ports (10–13, 11–12) of the respective heat exchanging media to define together with the adjacent channel forming plate (2) said distribution channel (18).

4. A plate heat exchanger according to claim 2, wherein said distribution channel (18) has a depth almost corresponding to half a maximum distance between the front cover plate (1) and the adjacent channel forming plate (2).

5. A plate heat exchanger according to claim 1, wherein the rear cover plate (8) is provided with the pressed pattern (9) and a pressed part (50) forming a distribution channel (18).

* * * * *